US009771842B2

(12) United States Patent
An

(10) Patent No.: US 9,771,842 B2
(45) Date of Patent: Sep. 26, 2017

(54) VIBRATION-TYPE OIL SEPARATOR AND BLOW-BY GAS RECIRCULATION SYSTEM EMPLOYING THE SAME

(71) Applicant: HYUNDAI MOTOR COMPANY, Seoul (KR)

(72) Inventor: Deog-Byoung An, Yongin-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 198 days.

(21) Appl. No.: 14/723,444

(22) Filed: May 27, 2015

(65) Prior Publication Data

US 2016/0108782 A1 Apr. 21, 2016

(30) Foreign Application Priority Data

Oct. 16, 2014 (KR) ..... 10-2014-0139592

(51) Int. Cl.
*F01M 13/00* (2006.01)
*F02B 25/06* (2006.01)
*F01M 13/04* (2006.01)

(52) U.S. Cl.
CPC ..... *F01M 13/04* (2013.01); *F01M 2013/005* (2013.01); *F01M 2013/0016* (2013.01);
(Continued)

(58) Field of Classification Search
CPC ..... F01M 13/04; F01M 2013/0016; F01M 2013/005; F01M 2013/0427; F01M 2013/0433; F01M 2013/045
(Continued)

(56) References Cited

U.S. PATENT DOCUMENTS 4,993,517 A * 2/1991 Leipelt ..... F01M 11/04 123/41.86
5,586,996 A * 12/1996 Manookian, Jr. .. B01D 46/0021 123/573
(Continued)

FOREIGN PATENT DOCUMENTS

JP 11-324636 A 11/1999
JP 2002-276328 A 9/2002
(Continued)

OTHER PUBLICATIONS

Japanese Office Action dated Sep. 15, 2015 issued in Japanese Patent Application No. 2014-097099 (English translation).

*Primary Examiner* — Syed O Hasan
(74) *Attorney, Agent, or Firm* — McDermott Will & Emery LLP

(57) ABSTRACT

A vibration-type oil separator includes a housing having a blow-by gas entering path through which a blow-by gas enters, an oil-discharging path which discharges an oil separated from the blow-by gas to outside, and a gas-discharging path which discharges a gas obtained by separating the oil from the blow-by gas to the outside. A vibration cylinder has an orifice formed thereon for escaping the gas and generating vibration by a back pressure of the blow-by gas and an external force applied to the housing to separate the oil and the blow-by gas. A fixing rod fixes the vibration cylinder in an internal space of the housing, in which both side portions thereof are fixed to the housing and a central portion thereof is fixed to the vibration cylinder.

10 Claims, 3 Drawing Sheets

(52) U.S. Cl.
CPC ..... *F01M 2013/045* (2013.01); *F01M 2013/0427* (2013.01); *F01M 2013/0433* (2013.01)

(58) Field of Classification Search
USPC ..... 123/198 E, 573, 572, 41.86
See application file for complete search history.

(56) References Cited

U.S. PATENT DOCUMENTS

| | | | | |
|---|---|---|---|---|
| 8,617,277 | B2 * | 12/2013 | De Paepe | B01D 46/0087 137/843 |
| 2008/0239617 | A1 | 10/2008 | Motoki et al. | |
| 2009/0027867 | A1 * | 1/2009 | Yamamoto | H05K 7/1458 361/785 |
| 2012/0161576 | A1 | 6/2012 | Motoki et al. | |

FOREIGN PATENT DOCUMENTS

| | | | |
|---|---|---|---|
| JP | 2005-103357 | A | 4/2005 |
| JP | 2007-073883 | A | 3/2007 |
| JP | 2008-283170 | A | 11/2008 |
| JP | 2010-232320 | A | 10/2010 |
| JP | 2012-134413 | A | 7/2012 |
| JP | 2013-073952 | A | 4/2013 |
| JP | 2013-096236 | A | 5/2013 |
| KR | 10-2010-0121596 | A | 11/2010 |

* cited by examiner

VIBRATION-TYPE OIL SEPARATOR AND BLOW-BY GAS RECIRCULATION SYSTEM EMPLOYING THE SAME

CROSS-REFERENCE TO RELATED APPLICATIONS

This application claims the benefit of priority to Korean Patent Application No. 10-2014-0139592 filed on Oct. 16, 2014, which is incorporated herein by reference in its entirety.

TECHNICAL FIELD

The present disclosure relates to an oil separator, more particular, a vibration-type oil separator in which oil is separated from blow-by gas by an engine vibrator and a back pressure of the blow-by gas, and a blow-by gas recirculation system using the same.

BACKGROUND

In general, blow-by gas generated in an internal combustion engine is high-pressure and high-temperature combustion gas and is leaked through a gap between a piston ring and a groove. Such blow-by gas contains unburned hydrocarbon, evaporating substance of engine oil, carbon particles and moisture which cause an environmental pollution when the blow-by gas is discharged to the atmosphere.

Therefore, in order to meet the vehicle exhaust gas regulation, a blow-by gas recirculation system (closed crankcase ventilation) is applied to the engine and an oil separator is applied to the blow-by gas recirculation system to remove oil components from the blow-by gas.

The oil separator includes a drain cup for collecting and discharging separated oil and a gas passage cup for discharging gas obtained by separating the oil from the blow-by gas, together with a gas flow guide.

Therefore, once the blow-by gas containing the oil and the gas in an engine crankcase enters the oil separator, the oil and the gas are separated from each other in the oil separator by the blow-by gas flow using an internal structure. Then, the oil is drained to an oil pan through the drain cup and the gas is conveyed to an intake duct through the gas passage cup.

As described above, since the oil separator separates the oil contained in the blow-by gas and collects the separated oil in the oil pan, it is possible to prevent evaporative components from adversely affecting on the components constituting the engine.

However, since the oil separator employs a cap, a diaphragm, a spring, cubs for the gas passage and the gas flow guide, a blow-by gas sucking guide, a case for an oil separation and a drain cup as the essential components, the size of the oil separator increases by a relatively large number of components, an excessive size of the oil separator causes a disadvantage in a weight and is disadvantage in terms of a package for mounting the engine.

A complicated internal structure in which the components constituting the oil separator are correlated with each other causes rise of manufacturing cost of the oil separator. Due to an excessive rise of cost, the above oil separator is disadvantage in terms of manufacturing cost.

SUMMARY

In view of the above problems, an aspect of the present inventive concept provides a vibration-type oil separator in which a vibration due to a back pressure formed by an internal flow of blow-by gas and an engine vibration transmitted when an engine is mounted promotes an oil separation to simplify an internal structure for the oil separation. In particular, a correlation structure of internal components is simplified by an oil-discharging path which directly uses a housing body and a gas-discharging path using an upward flow of the blow-by gas to reduce weight and manufacturing cost by eliminating the internal components, and a blow-by gas recirculation system employing the same.

According to an exemplary embodiment of the present inventive concept, a vibration-type oil separator includes a housing having a blow-by gas entering path which is formed on a side face thereof and through which a blow-by gas enters, an oil-discharging path which is formed below the blow-by gas entering path and discharges an oil separated from the blow-by gas to outside, and a gas-discharging path which is formed above the blow-by gas entering path and discharges a gas obtained by separating the oil from the blow-by gas to the outside. A vibration cylinder has a bell shape and is provided on the blow-by gas entering path. The vibration cylinder has an orifice formed thereon for escaping the gas and generating vibration by a back pressure of the blow-by gas and an external force applied to the housing to separate the oil and the gas in the blow-by gas. A fixing rod fixes the vibration cylinder vibrated in an internal space of the housing. The fixing rod has both side portions fixed to the housing and a central portion fixed to the vibration cylinder.

The blow-by gas entering path is a blow-by gas inlet port formed integrally with the housing, the oil-discharging path is an oil outlet port formed integrally with the housing, and the gas-discharging path is a gas outlet port formed integrally with the housing.

The housing comprises a lower body having the blow-by gas inlet port and the oil outlet port and an upper body having the gas outlet port. The vibration cylinder is disposed inside the lower body, a lower end portion of the upper body is connected to an upper end of the lower body, and both side portions of the fixing rod are fixed to the connected portions.

The lower body has an oil guide, which has a semicircular shape and is formed in the internal space of the lower body, surrounding a peripheral region of the blow-by gas inlet port and protruding by a certain height.

The upper body comprises a flow-guiding body having an internal space in which the gas escaped from the vibration cylinder is collected. A gas-discharging body has an internal space through which the gas is discharged from a hollow tube passage, which is in communicated with the internal space of the flow-guiding body, and flows to the gas outlet port.

The gas-discharging body has a gas guide formed in the internal space thereof and spaced apart from the gas outlet port. The diaphragm is disposed inside a cap which isolates the internal space of the gas-discharging body from the outside. The gas guide is separated from the diaphragm by a gas pressure so that the gas guide communicates with the gas outlet port.

The fixing rod divides the internal space of the housing into two spaces through which the gas escaped from the orifice passes.

A plurality of orifices are formed on the vibration cylinder.

According to another exemplary embodiment of the present inventive concept, a blow-by gas recirculation system includes a vibration-type oil separator composed of a lower body having an oil outlet port formed thereon and perpendicular to a blow-by gas inlet port that is formed on a side face of the lower body. A vibration cylinder has a blow-by gas passing through an internal space of the lower body to separate the blow-by gas and an oil by vibration caused due to a back pressure of the blow-by gas and engine vibration. A fixing rod has both side portions fixed to the lower body and a central portion fixed to the vibration cylinder. A flow-guiding body is connected to the lower body and has an internal space in which the blow-by gas escaped through an orifice of the vibration cylinder is collected. A gas-discharging body has a gas outlet port through which the gas that is discharged from a hollow tube passage communicated with the internal space of the flow-guiding body and then collected is discharged. A gas guide is spaced apart from the gas outlet port and protrudes upwards in the internal space of the gas-discharging body. A diaphragm is separated from the gas guide by a pressure of the gas collected in the internal space of the gas-discharging body so that the gas guide communicates with the gas outlet port. A cap isolates the internal space of the gas-discharging body from outside and is elastically supported by an elastic member. A blow-by gas entering line is connected to the blow-by gas inlet port and supplies the blow-by gas generated in a cylinder block to the lower body. A gas-discharging line connects the gas outlet port and an intake manifold using the cylinder block and delivers the gas, which is obtained by removing the oil from the blow-by gas, to the intake manifold. An oil-discharging line connects the oil-discharging port and an oil pan using the cylinder block and delivers the oil separated from the blow-by gas to the oil pan.

According to the oil separator of present disclosure, the oil separation is promoted by vibration using a back pressure of the blow-by gas which enters in and escapes out of the oil separator, thus simplifying the structure for the oil separation. Further, since engine vibration further promotes the oil separation, more effective oil separation performance is realized.

In addition, since the structure can be simplified by the oil-discharging path and the gas-discharging path without internal components, weight can be reduced, engine components can be secured, and manufacturing cost can be reduced.

DETAILED DESCRIPTION

Figure 1:
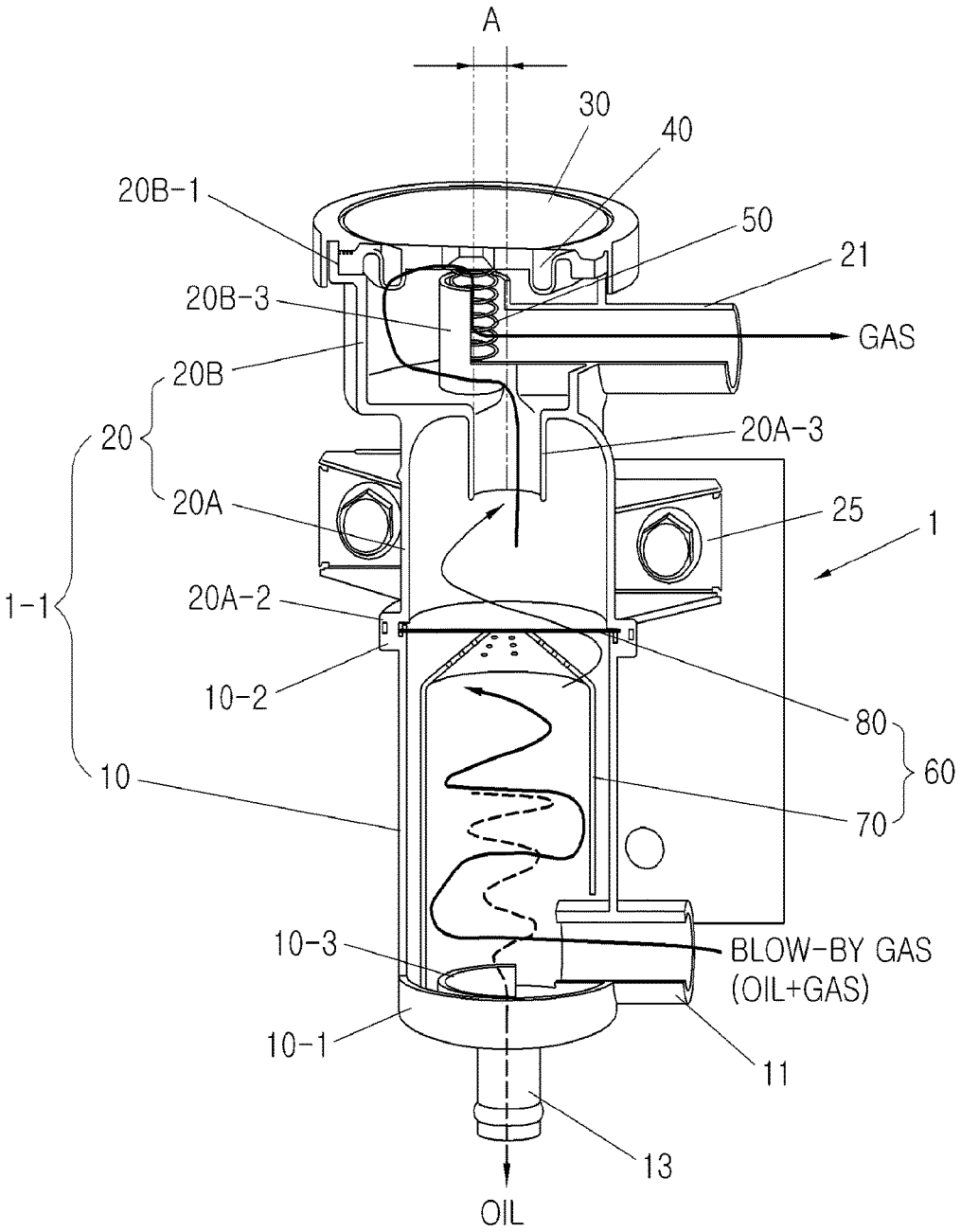
FIG. 1 is a view illustrating a structure of a vibration-type oil separator according to the present disclosure.

Exemplary embodiments of the present inventive concept will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like components throughout the various figures and embodiments of the present inventive concept.

FIG. 1 is a view illustrating a structure of a vibration type oil separator according to the present disclosure.

As shown in the figure, a vibration-type oil separator 1 includes a housing in which an oil-discharging path for an oil is formed below a blow-by gas entering path and a gas-discharging path for a gas obtained by removing the oil form the blow-by gas is formed above the blow-by gas entering path. A cap 30 is coupled to a gas-discharging flow portion to prevent gas from being discharged to outside. A vibration unit 60 divides the blow-by gas into the oil and the gas at a blow-by gas flowing path and promotes oil separation through vibration caused by a back pressure of the blow-by gas.

Specifically, the housing is composed of a lower body 10 and an upper body 20. In particular, a lower end portion of the upper body 20 is connected to an upper end portion of the lower body 10, and connecting portions of the lower body 10 and the upper body 20 are joined together by means of a bolting-coupling, fitting-coupling, or welding coupling method.

The blow-by gas enters the lower body 10, the lower body converts the blow-by gas into the gas obtained by separating the oil from the blow-by gas and discharges the oil separated from the blow-by gas to the outside. The lower body 10 includes a blow-by gas inlet port 11 causing the blow-by gas to enter an internal space in which the vibration unit 60 is provided, and an oil outlet port 13 through which the oil separated from the blow-by gas is discharged to the outside. In particular, a lower region of the lower body 10 is formed as a bottom surface 10-1 on which the oil separated from the blow-by gas passing the vibration unit 60 is collected, the oil collected in the bottom surface 10-1 flows to the oil outlet port 13. An upper region of the lower body is formed as an extension flange 10-2 coupled to the upper body 20 to secure the vibration unit 60. In addition, a semi-circular shaped oil guide 10-3 surrounding a peripheral region of the blow-by gas inlet port 11 and protruded by a certain height is formed on the bottom surface 10-1.

The upper body 20 includes a flow-guiding body 20A in which the gas (the oil is removed from the gas through the vibration unit 60) is collected, and a gas-discharging body 20B forming a flow path through which the gas discharged from the flow-guiding body 20A is discharged. The gas-discharging body 20B is formed as an upper part of the flow-guiding body 20A and is formed integrally with the flow-guiding body. To this end, the flow-guiding body 20A has an extension flange 20A formed thereon and connected to the extension flange 10-2 of the lower body 10 and has a hollow tube passage 20A-3 formed therein for communicating the internal space thereof with the gas-discharging body 20B. In addition, a mounting bracket 25 is formed on the flow-guiding body for mounting the housing to an engine. The gas-discharging body 20B has an extension flange 20B-1 formed thereon and coupled to the cap 30. A gas guide 20B-3 is disposed inside the gas-discharging body 20B, spaced apart from an exit of the hollow tube passage 20A-3 (from which the gas is escaped) at a distance A, and protrudes from a bottom surface to divide the internal space of the flow-guiding body 20A. A gas outlet port 21 is formed on the gas-discharging body 20B for discharging the gas to the outside. In particular, the gas guide 20B-3 is located in front of the gas outlet port 21, thus forming a by-pass path, and the gas escaped from the hollow tube passage 20A-3 does not directly enter the gas outlet port 21 but flows in this by-pass path.

Specifically, the cap 30 is coupled to the gas-discharging body 20B to allow the gas obtained by separating the oil from the blow-by gas to be discharged to the gas outlet port 21. In particular, the cap 30 has a diaphragm 40 and an elastic member 50, the diaphragm 40 is placed on an inner circumferential surface of the cap 30 to allow a discharge passage leading to the gas outlet port 21 to be opened with a pressure of the gas obtained by separating the oil from the blow-by gas. As the elastic member 50, a coil spring which elastically supports the cap 30 may be employed.

Specifically, the vibration unit 60 includes a vibration cylinder 70 and a fixing rod 80. The vibration cylinder 70 has a bell shape such that while the blow-by gas moves upward, the oil is separated from the blow-by gas and the gas is then escaped via an orifice 77 formed on the vibration cylinder. This vibration cylinder is received in the internal space of the lower body 10. The fixing rod 80 is in the form of a slender circular rod having a circular cross section or of a slender bar having a rectangular cross section. When a central portion of the fixing rod is fixed to the vibration cylinder 70, both side portions are fixed by means of the lower body 10 or the flow-guiding body 20A. In particular, the fixing rod 80 is spot-welded to the vibration cylinder 70 so that the fixing rod 80 generates a fixing force by which a fixing state between the fixing rod 80 and the vibration cylinder 70, which vibrates, is maintained.

Figure 2:
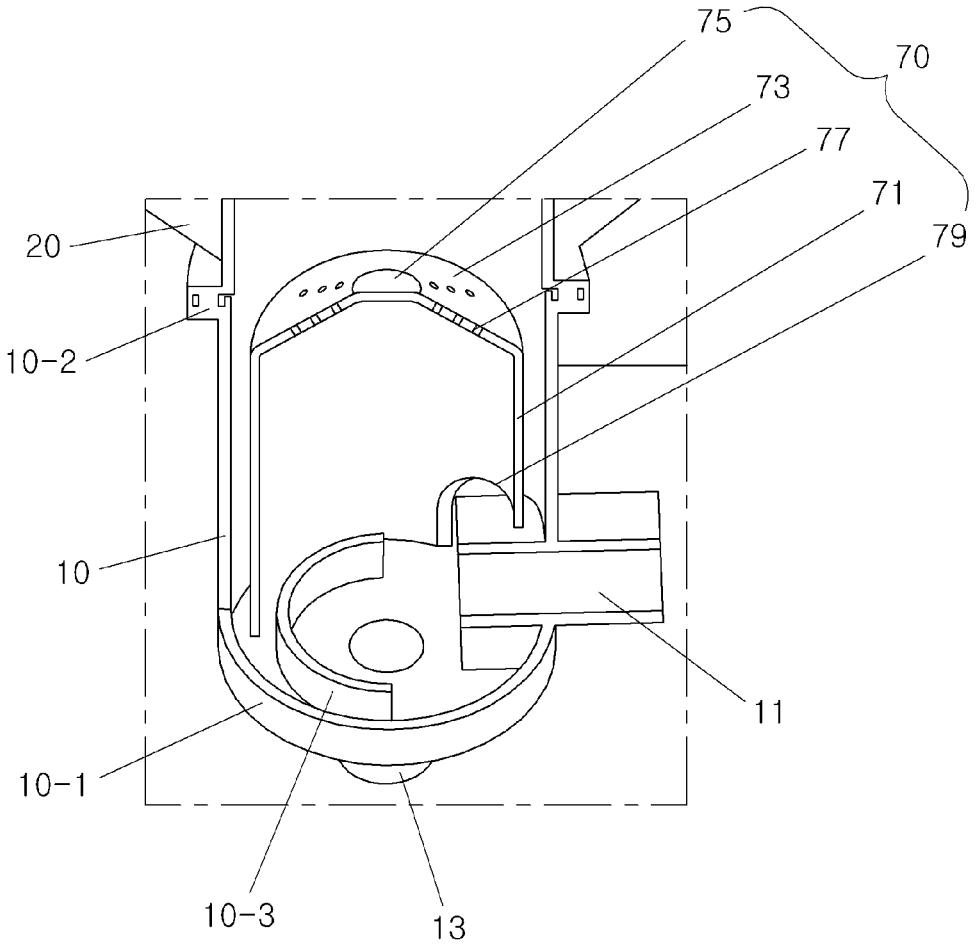
FIG. 2 is a view illustrating a detail structure of a vibration cylinder according to the present disclosure.

FIG. 2 shows a detail structure of the vibration cylinder 70. The vibration cylinder 70 includes a bell-shaped cylinder body 71 having the orifice 77 formed on a bottom face 73 which opposites to an opened side and has a conical shape. A fixing face 75 is formed at an apex region of the conical shaped bottom face 73 and has a flat shape to allow the fixing rod 80 to be welded thereto. A cutout opening 79 is formed by cutting the opened side of the cylinder body 71 according to a shape of the blow-by gas inlet port 11 to allow the blow-by gas inlet port 11 to be inserted into the cutout opening 79. In particular, a plurality of orifices 77 are radially disposed from the apex region of the bottom face 73.

Figure 3:
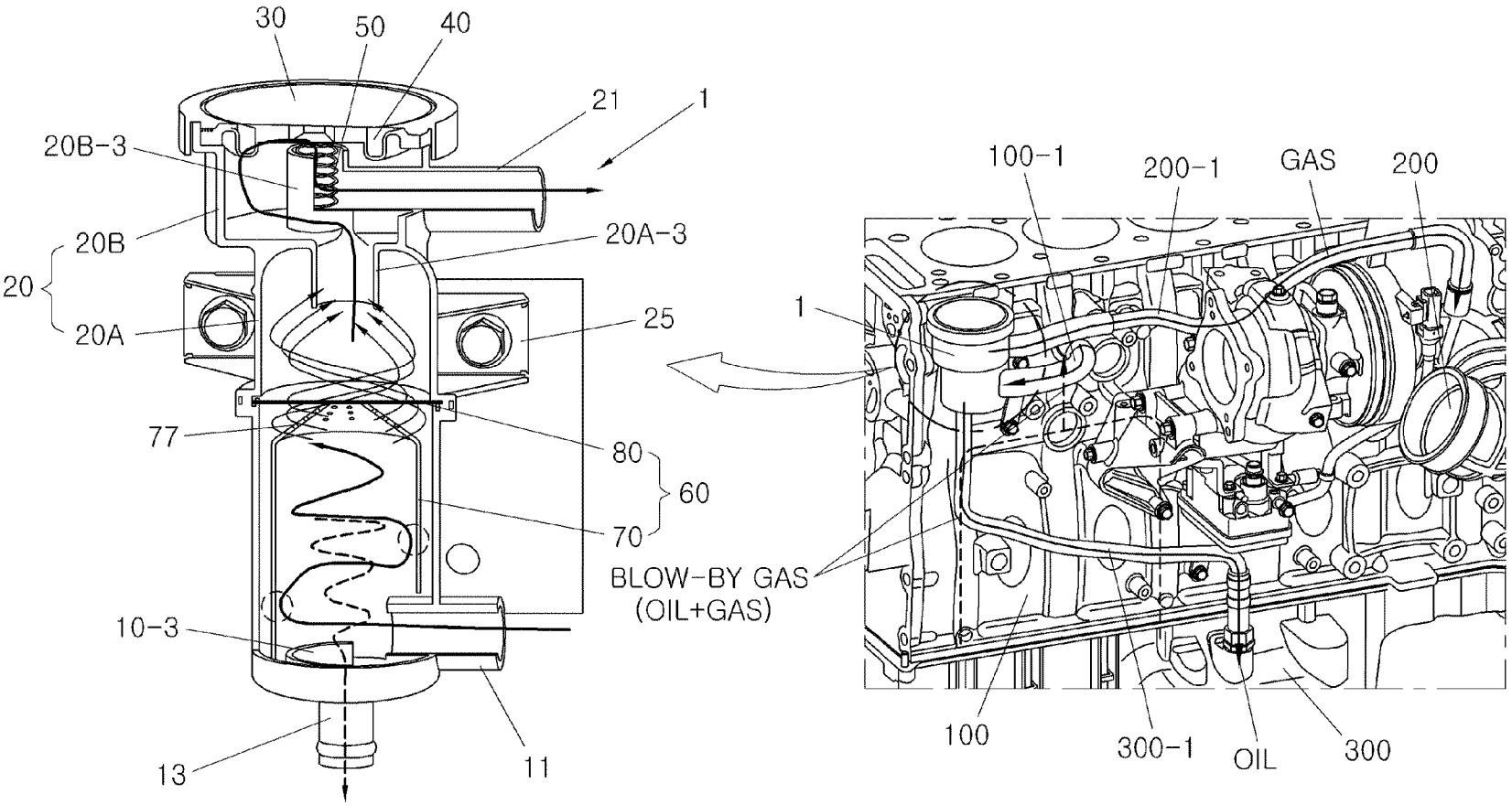
FIG. 3 is a view showing an operating state of a blow-by gas recirculation system having a vibration-type oil separator according to the present disclosure.

FIG. 3 shows an operating state of a blow-by gas recirculation system having the vibration-type oil separator 1.

As shown in the drawing, the blow-by gas recirculation system includes the vibration-type oil separator 1, a blow-by gas entering line 100-1, a gas-discharging line 200-1 and an oil-discharging line 300-1.

As described above with reference to FIGS. 1 and 2, the vibration-type oil separator 1 includes the lower body 10, the upper body 20 having the flow-guiding body 20A and the gas-discharging body 20B, the cap 30, the diaphragm 40, the elastic member 50, the vibration cylinder 70, and the fixing rod 80. And, the vibration-type oil separator is mounted to a cylinder block 100 via the mounting bracket 25 of the flow-guiding body 20A.

In conjunction with the blow-by gas recirculation system, an operation of the vibration-type oil separator 1 is performed as below.

The vibration cylinder 70 is composed of the cylinder body 71, the bottom face 73, and the orifice 77, and is fixed to the fixing rod 80 by the fixing face 75. The blow-by gas inlet port 11 of the lower body 10 is placed in the cutout opening 79. Therefore, once the blow-by gas enters an internal space of the cylinder body 71 through the blow-by gas entering line 100-1 connected to the blow-by gas inlet port 11, a back pressure of the blow-by gas vibrates the vibration cylinder 70. In addition, an engine vibration transmitted to the cylinder body 71 via the cylinder block 100 also vibrates the vibration cylinder 70 so that the vibration caused by the back pressure of the blow-by gas and the engine vibration make the vibration cylinder 70 generate the vibration.

Therefore, while the blow-by gas discharged from the blow-by gas entering line 100-1 flows from the lower body 10 to the upper body 20 and before the blow-by gas escapes through the orifice 77, the blow-by gas is bumped into an inner face of the cylinder body 71 and the bottom face 73 on which the orifice 77 is formed so that the blow-by gas is divided into the gas and the oil.

In the vibration-type oil separator 1, the oil separated from the blow-by gas is then discharged to an outside through the oil outlet port 13 provided on the bottom surface 10-1 of the lower body 10. As a result, the oil discharged from the oil outlet port 13 flows to the oil-discharging line 301-1 and is then stored in an oil pan 300. Due to the vibration of the vibration cylinder 70 and the gravity action, the oil fallen toward the oil outlet port 13 is more rapidly collected in an inside of the oil guide 10-3. In addition, the oil guide 10-3 makes the fallen oil be collected toward the oil outlet port 13.

In the vibration-type oil separator 1, on the contrary, the gas obtained by removing the oil from the blow-by gas enters the upper body 20 connected to the lower body 10 and is escaped to the gas outlet port 21. Specifically, the gas in the flow-guiding body 20A is escaped to the gas-discharging body 20B through the hollow tube passage 20A-3, and a rear space of the gas guide 20B-3 is filled with the gas entered the gas-discharging body 20B so that a pressure is generated on the diaphragm 40. Then, due to a pressure rise caused by a continuous gas inflow, the diaphragm 40 is separated from the gas guide 20B-3 so that the internal space of the gas-discharging body 20B is communicated in fluid with the gas outlet port 21. As a result, the gas escaped from the gas outlet port 21 is supplied to an intake manifold 200 through the gas-discharging line 200-1 installed on the cylinder block 100 and connected to the gas outlet port 21.

As described as above, the vibration type oil separator 1 constituting the blow-by gas recirculation system according to the present disclosure includes the vibration cylinder 70 separating the oil and the blow-by gas through the back pressure of the blow-by gas entered from the blow-by gas flowing path formed in the internal space of the housing composed of the lower body 10 and the upper body 20 and a vibration caused by the external force transmitted to the housing, and the fixing rod 80 is provided for fixing the vibration cylinder 70 to the housing. Thus, correlated structures among the components in the housing can be simplified, weight and manufacturing cost of the oil separator can be reduced by eliminating the components, and engine components can be secured.

While the present disclosure has been described with respect to the specific embodiments, it will be apparent to those skilled in the art that various changes and modifications may be made without departing from the spirit and scope of the disclosure as defined in the following claims.

What is claimed is:

1. A vibration-type oil separator, comprising:

a housing having a blow-by gas entering path which is formed on a side face thereof and through which a blow-by gas enters, an oil-discharging path which is formed below the blow-by gas entering path and discharges an oil separated from the blow-by gas to outside, and a gas-discharging path which is formed above the blow-by gas entering path and discharges a gas obtained by separating the oil from the blow-by gas to the outside;

a vibration cylinder having a bell shape and provided on the blow-by gas entering path, the vibration cylinder having an orifice formed thereon for escaping the gas and generating vibration by a back pressure of the blow-by gas and an external force applied to the housing to separate the oil and the blow-by gas; and a fixing rod fixing the vibration cylinder in an internal space of the housing, both side portions thereof fixed to the housing and a central portion thereof fixed to the vibration cylinder, wherein the housing comprises a lower body having a blow-by gas inlet port and an oil outlet port, and an upper body having a gas outlet port, wherein the upper body comprises:

a flow-guiding body having an internal space in which the gas escaped from the vibration cylinder is collected; and a gas-discharging body having an internal space through which the gas is discharged from a hollow tube passage, which communicates with the internal space of the flow-guiding body, and flows to the gas outlet port, wherein the gas-discharging body includes:

a gas guide formed in the internal space thereof, spaced apart from the gas outlet port; and a diaphragm disposed inside a cap which isolates the internal space of the gas-discharging body from the outside, and wherein the gas guide is separated from the diaphragm by a gas pressure so that the gas guide communicates with the gas outlet port.

2. The vibration-type oil separator of claim 1, wherein the blow-by gas entering path is the blow-by gas inlet port formed integrally with the housing, the oil-discharging path is the oil outlet port formed integrally with the housing, and the gas-discharging path is the gas outlet port formed integrally with the housing.

3. The vibration-type oil separator of claim 1, wherein the vibration cylinder is disposed inside the lower body, a lower end portion of the upper body is connected to an upper end of the lower body, and both side portions of the fixing rod are fixed to a connection portion of the lower body and the upper body.

4. The vibration-type oil separator of claim 1, wherein the lower body has an oil guide, which has a semi-circular shape and is formed in an internal space of the lower body, surrounding a peripheral region of the blow-by gas inlet port and protruding upwards.

5. The vibration-type oil separator of claim 1, wherein the gas guide has an arc shape and surrounds the gas outlet port.

6. The vibration-type oil separator of claim 1, wherein the fixing rod divides the internal space of the housing into two spaces through which the gas escaped from the orifice passes.

7. The vibration-type oil separator of claim 1, wherein a plurality of orifices are formed on the vibration cylinder.

8. A blow-by gas recirculation system, comprising:

a vibration-type oil separator including a lower body which has an oil outlet port formed thereon and is perpendicular to a blow-by gas inlet port formed on a side face of the lower body, a vibration cylinder having a blow-by gas passing through an internal space of the lower body to separate the blow-by gas and an oil by vibration caused due to a back pressure of the blow-by gas and engine vibration, a fixing rod having both side portions fixed to the lower body and a central portion fixed to the vibration cylinder, a flow-guiding body connected to the lower body and having an internal space in which the gas escaped through an orifice of the vibration cylinder is collected, a gas-discharging body having a gas outlet port through which the gas that is discharged from a hollow tube passage communicating with the internal space of the flow-guiding body and then collected is discharged, a gas guide spaced apart from the gas outlet port and protruding upwards in the internal space of the gas-discharging body, a diaphragm separated from the gas guide by a pressure of the gas collected in the internal space of the gas-discharging body so that the gas guide communicates with the gas outlet port, and a cap isolating the internal space of the gas-discharging body from outside and elastically supported by an elastic member;

a blow-by gas entering line connected to the blow-by gas inlet port and supplying the blow-by gas generated in a cylinder block to the lower body;

a gas-discharging line connecting the gas outlet port and an intake manifold using the cylinder block and delivering the gas, which is obtained by removing the oil from the blow-by gas, to the intake manifold; and an oil-discharging line connecting the oil-discharging port and an oil pan using the cylinder block and delivering the oil separated from the blow-by gas to the oil pan.

9. The blow-by gas recirculation system of claim 8, wherein the vibration-type oil separator is bolt-coupled to the cylinder block via a mounting bracket of the flow-guiding body.

10. The blow-by gas recirculation system of claim 8, wherein the cap is elastically supported by an elastic member.

* * * * *